United States Patent [19]

Giaier et al.

[11] Patent Number: 4,616,573

[45] Date of Patent: Oct. 14, 1986

[54] METERING FEEDER

[75] Inventors: Thomas A. Giaier, Ypsilanti; Neil H. Johnson, Grosse Ile; David C. Reschly, Monroe; Harold L. Knox, Grosse Ile, all of Mich.; Kim E. Spurlock, Toledo, Ohio

[73] Assignee: Detroit Stoker Company, Monroe, Mich.

[21] Appl. No.: 747,372

[22] Filed: Jun. 20, 1985

Related U.S. Application Data

[63] Continuation of Ser. No. 558,376, Dec. 5, 1983, abandoned, which is a continuation-in-part of Ser. No. 490,657, May 2, 1983.

[51] Int. Cl.[4] ..... F23K 3/00

[52] U.S. Cl. ..... 110/327; 110/109; 110/118; 110/219; 110/289; 110/293; 198/546; 198/550.5; 414/173; 414/187; 414/327

[58] Field of Search ..... 110/101 R, 101 CF, 101 CA, 110/102, 108–110, 118, 186, 218–220, 222, 267, 286, 289, 293, 327, 235; 414/173, 187, 325, 327; 198/533, 546, 550

[56] References Cited

U.S. PATENT DOCUMENTS

| | | | |
|---|---|---|---|
| 309,920 | 12/1884 | Bird | 198/546 |
| 1,001,592 | 8/1911 | Hayes | 110/108 |
| 1,067,615 | 7/1913 | Marcelle | 198/546 |
| 1,325,589 | 12/1919 | Smith | 198/533 |
| 2,011,284 | 8/1935 | Hunt | 110/101 R |
| 2,195,278 | 3/1940 | Leas | 110/109 |
| 2,215,067 | 9/1940 | Denison et al. | 110/101 CA |
| 2,391,597 | 12/1945 | Schwendner | 198/546 |
| 2,444,985 | 7/1948 | Felton | 414/173 |
| 2,581,720 | 1/1952 | Schulte | 198/533 |
| 2,773,629 | 12/1956 | Miller | 110/293 |
| 2,813,703 | 11/1957 | Kersten | 198/546 |
| 3,159,290 | 12/1964 | Hesse . | |
| 3,680,719 | 8/1972 | Reilly | 110/109 |
| 3,785,304 | 1/1974 | Stookey | 110/118 |
| 4,183,472 | 1/1980 | Packard et al. | 198/533 |
| 4,281,603 | 8/1981 | Probsteder | 110/196 |
| 4,337,711 | 7/1982 | Bolton | 110/235 X |
| 4,430,949 | 2/1984 | Ekenberg | 110/110 |

*Primary Examiner*—Albert J. Makay
*Assistant Examiner*—Steven E. Warner
*Attorney, Agent, or Firm*—Harness, Dickey & Pierce

[57] ABSTRACT

A metering feeder for delivering solid fuels, such as municipal or industrial refuse, for combustion includes a pair of generally vertically arranged hoppers. An upper hopper containing relatively compacted or intertangled fuel discharges metered amounts of fuel into a lower hopper through the action of a ram-type pusher. Fuel discharged from the upper hopper is dropped into the lower hopper to develop sufficient kinetic energy to decompact the fuel. An upwardly inclined conveyor removes fuel from the lower hopper at an independently metered rate under optional control of a combustion control system. The action of the inclined conveyor further decompacts the fuel by underraking and mixing, thereby providing a well controlled, uniform, loose density fuel for combustion. The conveyor has a closed course of cleats which cyclically moves to remove fuel. The cleats extend in acute angular relation to the direction of movement for improved performance.

14 Claims, 11 Drawing Figures

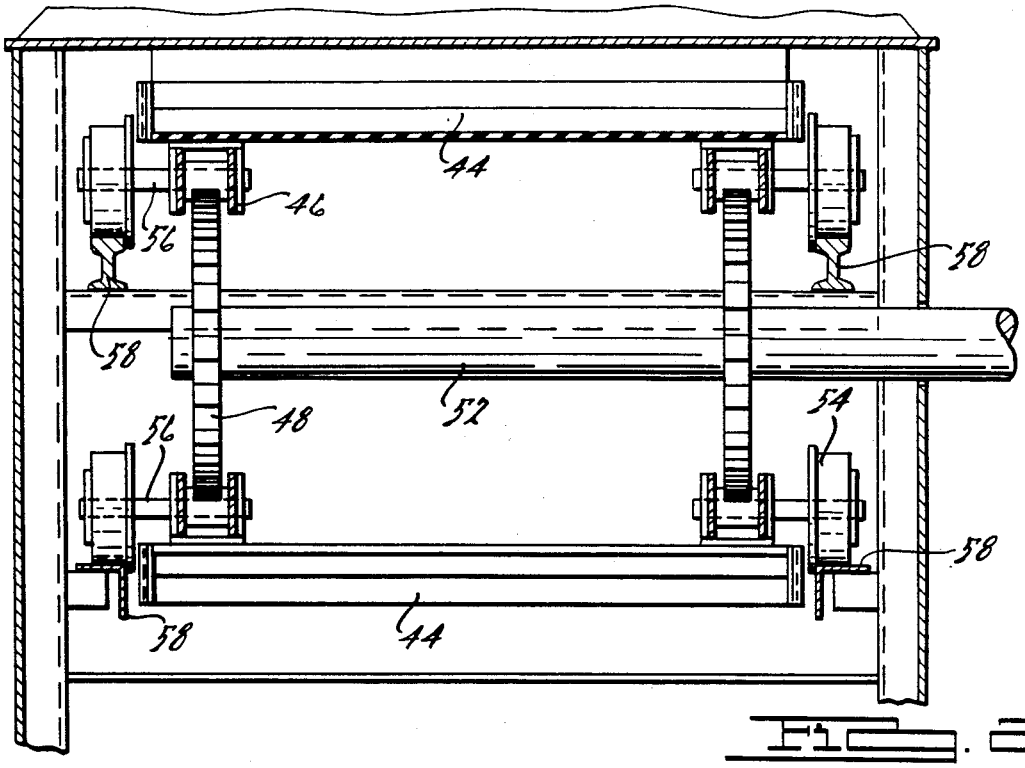
FIG. 2.
FIG. 3.
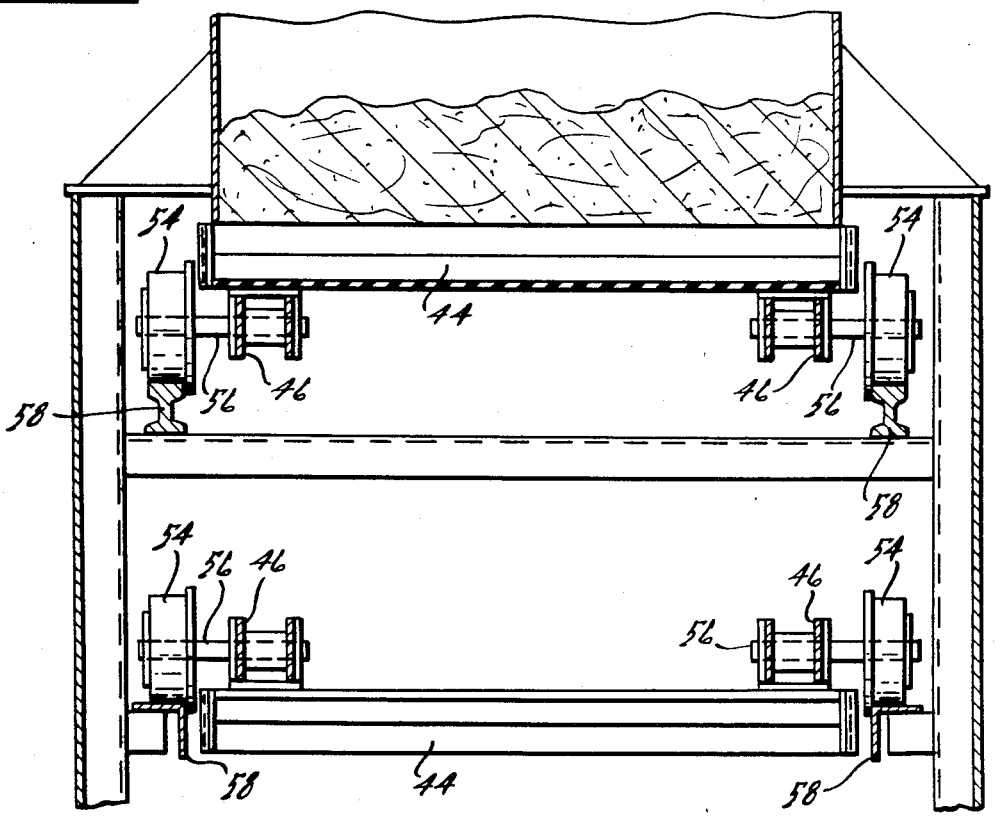

METERING FEEDER

CROSS-REFERENCE TO RELATED APPLICATION

This application is a continuation of application Ser. No. 558,376, filed Dec. 5, 1983, now abandoned which is a continuation-in-part of copending application Ser. No. 490,657, entitled "Metering Feeder For Refuse Derived Fuels", filed May 2, 1983.

BACKGROUND OF THE INVENTION

1. Field of the Invention

This invention pertains generally to feeders and stokers, and in particular to a feeder for metering and delivering refuse fuel to a furnace, boiler, air heater, kiln, combustion chamber or any device requiring a controlled rate of feed in comparatively homogeneous unit energy per unit weight amounts.

2. Description of the Prior Art

It has been generally recognized that municipal and industrial refuse as well as cellulose waste materials are desirable as a fuel to conserve fossil energy. Such use helps to control and greatly reduce the volume of refuse for disposal by alternative methods such as composting or landfill.

One significant problem with refuse as a fuel is that generally refuse is quite heterogeneous, that is, quite nonuniform on a unit energy per unit volume or per unit weight basis. The bulk density of refuse fuel can vary from 3 pounds per cubic foot in a loose state to 40 pounds per cubic foot in a compacted hopper, for example. Refuse fuel intertangles in the compacted state which causes undesirable bridging, clogging or matting within the bin or hopper, and contributes to irregular feeding.

It is often desirable to feed refuse to a boiler, combustion chamber or the like on a volumetric basis. Preferably the fuel should be supplied at a controlled rate and in a loose density state in order to promote even burning, to maintain a controlled density and thereby maintain control over the combustion process. Prior art devices have been generally deficient in this regard.

SUMMARY OF THE INVENTION

According to the present invention, a method and apparatus is provided whereby refuse fuel is placed into a feed hopper in a relatively compacted, naturally intertangled state. A predetermined volume of the fuel is segregated, discharged or ejected from the feed hopper by means of a ram type pusher which displaces the lowermost stratum of material through an opening in the hopper. The fuel discharged from the hopper is decompacted by dropping it into a receiving hopper disposed generally beneath the feed hopper. An upwardly inclined conveyor, employing closely spaced extending slats, pans or cleats, removes the fuel from the receiving hopper at a controlled rate. The action of the inclined conveyor also serves to mix and further decompact the fuel by underraking and over tumbling action. The invention is also ideally suited for use with a combustion control system whereby the energy released during combustion can be measured to control the rate at which fuel is removed from the receiving hopper.

Other objects, features, and advantages of the present invention will become apparent from the subsequent description and the appended claims, taken in conjunction with the accompanying drawings, in which:

BRIEF DESCRIPTION OF THE DRAWINGS

FIG. 2 is a sectional view taken along the line 2—2 of FIG. 1;

FIG. 3 is a sectional view taken along the line 3—3 of FIG. 1;

DESCRIPTION OF THE PREFERRED EMBODIMENT

Figures 1, 4:
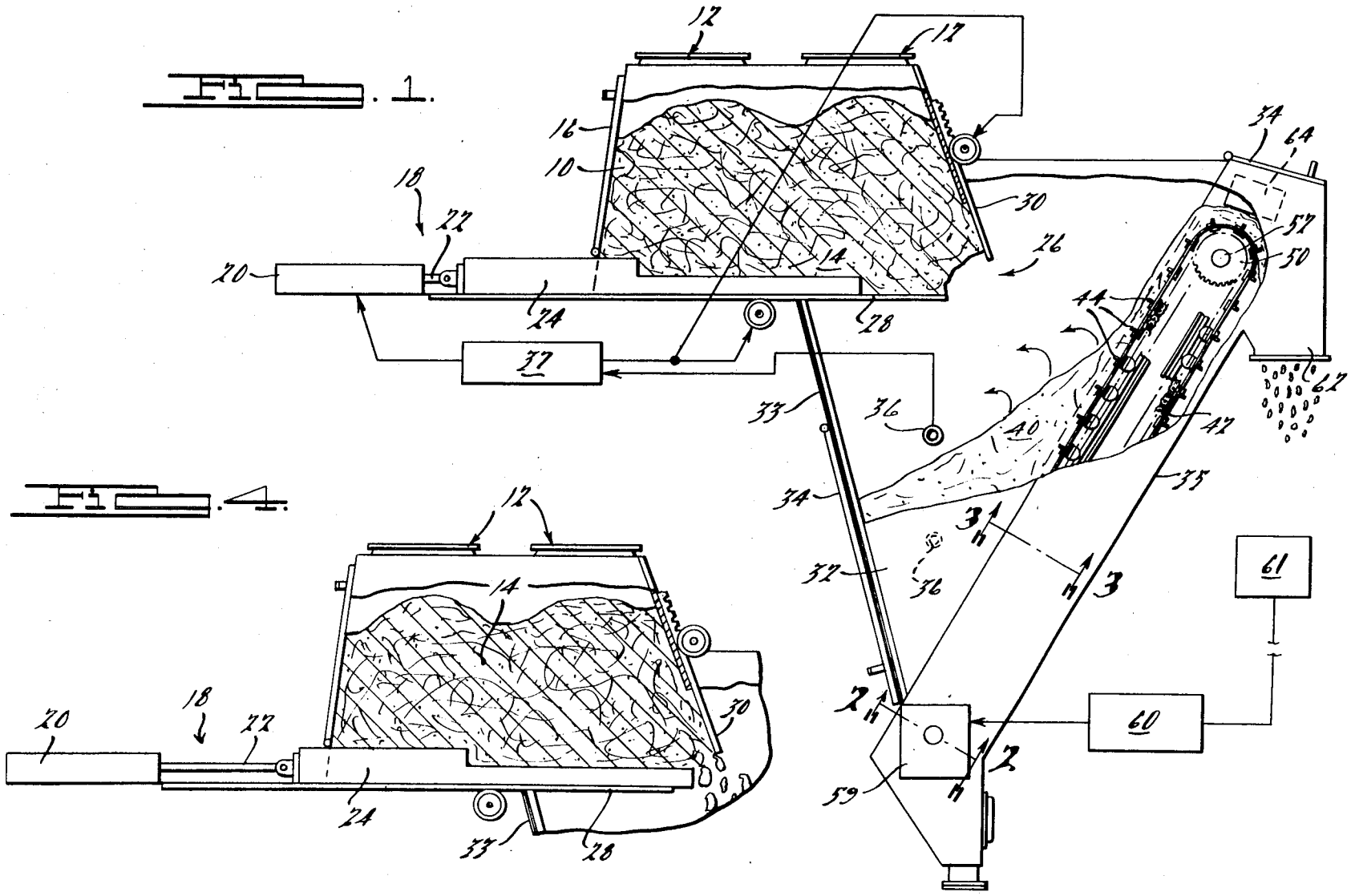
FIG. 1 is a schematic side view of the invention.
FIG. 4 is a fragmentary view showing fuel falling from the feed hopper.

Referring principally to FIG. 1, the invention comprises feed hopper 10 having infeed spouts 12 for filling hopper 10 with refuse fuel, or other material denoted generally by reference numeral 14. To permit access to the interior of hopper for inspection or periodic cleaning hinged door 16 is provided. Reciprocating ram pusher or feeder 18, having fixed cylinder 20 and reciprocating plunger or piston rod 22 with stepped pusher or ram 24 attached thereto, is operable to push, force or segregate a volume of refuse 14 out through discharge opening 26. The quantity of refuse discharged through opening 26 is dependent upon the volume displaced by ram 24 and also upon the size of opening 26. To effect positive control over the quantity discharged, ram feeder 18 may be hydraulically operable at a controlled speed or cycle rate and/or with a controlled stake displacement. Alternatively, ram feeder 18 may be air operated or mechanically operated. In addition, the size of opening 26 may be varied by means of an adjustable bottom plate 28 and plate 30. It will be recognized that plates 28 and 30 may be made manually operable using hand wheels or the like, or they may be motorized for remote control.

Figure 5:
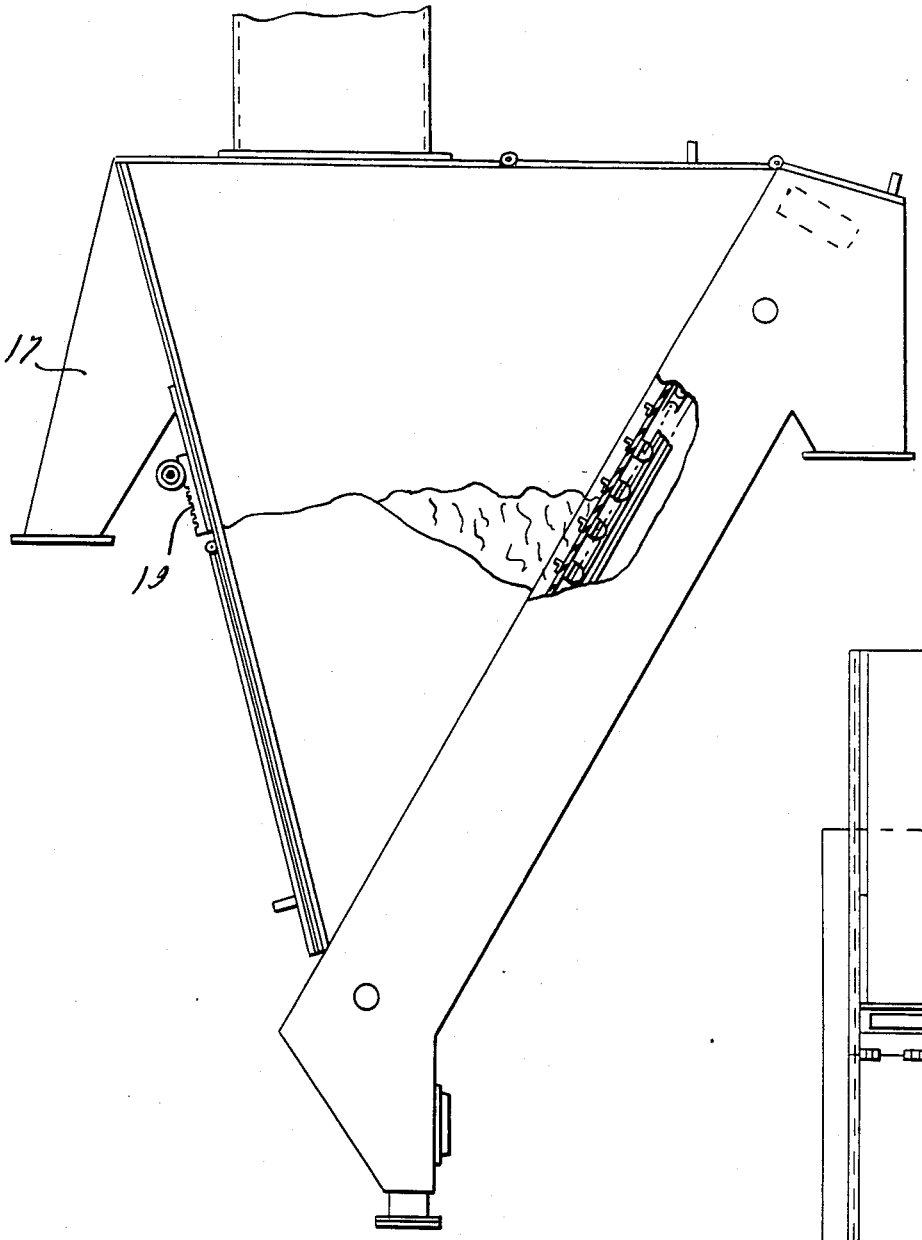
FIG. 5 is a side view of the invention showing optional overflow discharge spout.
Figure 6:
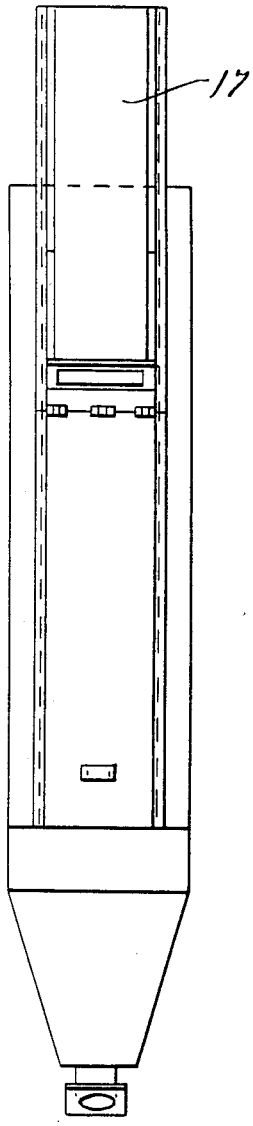
FIG. 6 is an end view of the invention of FIG. 5 showing overflow discharge spout.
Figure 10:
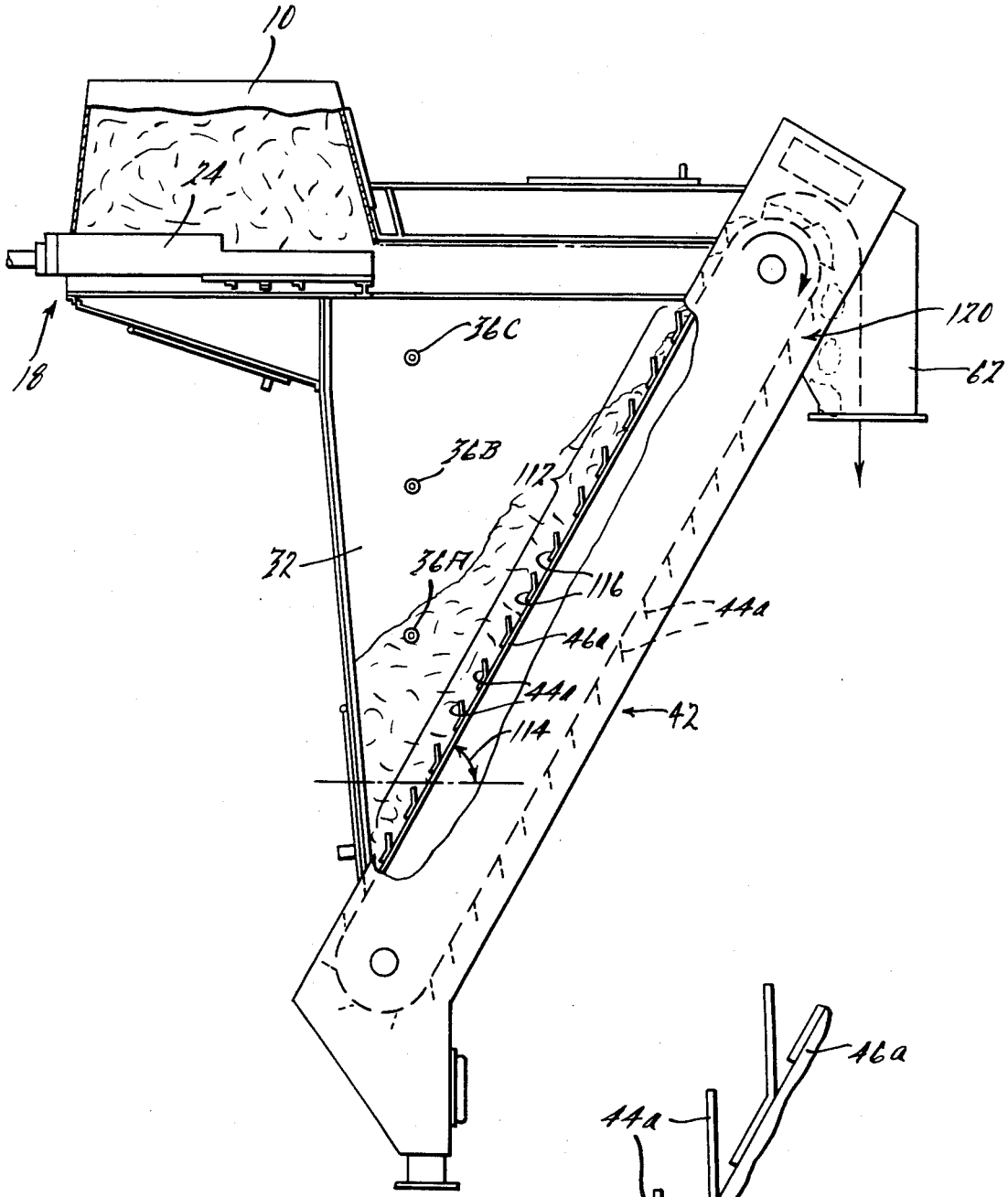
FIG. 10 is a schematic side view of another embodiment of the invention, featuring a conveyor with upwarding inclined cleats.

The invention further comprises receiving hopper 32 having inwardly sloping plates 33 and 35. Receiving hopper 32 is provided with hinged doors 34 for gaining access to the interior of the hopper in order to clean or inspect. Hopper 32 may include optional overflow discharge spout 17 with adjustable gate 19, as shown in FIGS. 5 and 6, for controlling the level in the receiving hopper 32. One or more level indicators 36 detect the quantity or level of refuse fuel within hopper 32 and provide a signal indicative thereof. The signal may be used, for example, as an input to conventional circuitry 37 for controlling the cycle rate of ram feeder 18 and/or for controlling adjustable plates 28 and 30 thereby controlling the volume or rate of refuse fuel being discharged from hopper 10. In this fashion it can be ensured that hopper 32 will not be overfilled. Alternatively, the signal may be used to control adjustable gate 19. In the presently preferred embodiment, the invention uses three level indicators 36A, 36B, and 36C as shown in FIG. 10. Ram feeder 18 is operable at two speeds, a high speed and a low speed. The proper speed is selected according to which of the three level indicators 36A, 36B, and 36C detects refuse. When only the lowermost level indicator 36A detects refuse, ram feeder 18 operates at the high speed to quickly fill receiving hopper 32. When the level of refuse rises to the intermediate leve indicator 36B, the ram feeder speed is decreased to the low speed. At the low speed equilibrium is usually reached whereby the infeed of fuel from ram feeder 18 is equalled by the outfeed of fuel via conveyor 42. Should equilibrium not be reached such that the infeed outpaces the outfeed, level indicator 36C senses the condition and stops ram feeder 18 before overflow can occur. Once ram feeder 18 is stopped by level indicator 36C, it remains off until the level of fuel within receiving hopper 32 once again reaches level indicator 36B. In the alternative, should outfeed via conveyor 42 exceed the infeed from ram feeder 18, thereby causing the level of fuel in receiving hopper 32 to drop rather than reach equilibrium, level indicator 36A senses the condition and initiates high speed operation.

Alternatively intermediate level indicator 36B may initiate an adjustable timer to result in a delay cycle between strokes of the ram feeder 18. In this mode of operation, the ram feeder 18 travels at a fixed speed. The ram feeder 18 may thus be considered as a means for periodically introducing fuel into hopper 32. Either the frequency of introduction (ram speed) or the period of introduction (time between strokes), or both may be varied in accordance with the level indicators.

As will be explained more fully below, refuse fuel being discharged from hopper 10 is permitted to fall or drop into hopper 32, the drop being of sufficient distance to untanlge or decompact the refuse fuel. In FIG. 1 the drop distance is dentoed by reference character D as being the verticle distance between discharge opening 26 and the top of the pile of refuse fuel 40 within hopper 32. Clearly the drop distance D can be adjusted by adjusting the level of refuse fuel in hopper 32. In accordance with the present invention, drop distance D is selected such that the charge of fuel, when dropped from hopper 10, will develop sufficient kinetic energy as it falls to cause the charge to decompact within hopper 32 upon impact with the walls of hopper 32 of with fuel pile 40. In addition, during free fall, wind resistance forces and internal or pent up spring-like forces stored within the charge during original compaction act upon the charge to cause further decompaction. Free fall duration depends upon the drop distance; thus drop distance D can be readily adjusted to control the degree to decompaction.

In the presently preferred embodiment described above, receiving hopper 32 is fed or filled by the action of ram feeder 18. In another embodiment, shown in FIG. 5, receiving hopper 32 is fed or filled from infeed spout 21 which may be coupled to any of a wide variety of material handling devices (not shown). In addition, excess or overflow material from discharge spout 17 may be conveyed back to the prime supply of material or to any desired intermediate supply point.

Disposed within hopper 32 is upwardly inclined conveyor 42 having a plurality of closely spaced cleats or flights 44. Conveyor 42 may take the form of a continuous belt having slats preferably equally spaced about the outer periphery of the belt, or it may take the form of a plurality of equally spaced pans carried on a closed loop chain or chains, both types of conveyors being well known in the art. It will be recognized, however, that generally a wide variety of conveyor mechanisms can be used to practice the invention, and accordingly the scope of the invention is not hereby limited to belt-type or pan-type conveyor mechanisms. For purposes of illustrating the invention a chain conveyor or apron conveyor has been illustrated.

As will be explained more fully below, the action of the conveyor 42 serves to mix or tumble the refuse fuel 40 as by underraking, which also serves to untangle, breakup and otherwise further decompact the refuse fuel. Towards this end, the angle of incline of conveyor 42, measured from the horizontal, is selected so that a portion of the refuse fuel initially picked up by the conveyor will fall or tumble back onto the pile, thereby decompacting or loosening the fuel. It has been found that an angle of incline greater than 20 degrees, preferably between 35 and 75 degrees, gives satisfactory results, although shallower angles are also usable. The particular angle of incline needed for good tumbling action is dependent in part upon the handling characteristics of the material, and its agglomerating and cohesive tendencies. In general, the angle of the conveyor must be greater than the normal angle of repose of the material handled so that the material will fall back, causing rolling or tumbling of any agglomerated material. In addition, sidewall 33 which constitutes the backplate of hopper 32, has an angle of incline with respect to the horizontal, preferably between 60 and 90 degrees. This incline causes refuse material to fall inwardly and downwardly toward conveyor 42, which promotes constant recirculation of the material and a mixing action. The particular backplate angle selected will depend upon the handling characteristics, and the agglomerating and cohesive tendencies of the material, in order to get the desired mixing action. With the correct angle of the conveyor and backplate, the material being handled will be pulled out from the bottom of the pile which results in the material at the back of the hopper 32 continually moving downward. Such action causes mixing in a counter-clockwise direction (viewed from the side as in FIG. 1).

With reference to FIGS. 1, 2 and 3, conveyor 42 comprises drive chains 46 carried between lower sprocket 48 and upper sprocket 50 which are secured for rotation about axles 52. Attached at equally spaced intervals about chains 46 are a plurality of generally horizontal flights or pans 44 for conveying material thereon. To keep drive chains 46 from sagging, outboard rollers 54 are attached through spindles 56 to drive chains 46 for rolling movement along rails 58.

Conveyor 42 is driven by motor 59 which may be under the control of combustion control system 60. Combustion control system 60, which may be based on any on the well known motor control circuit designs, is responsive to sensors 61 such as any on the well known temperature or pressure sensors, located in the combustion area. At the upper end of conveyor 42 is chute 62 through which the refuse fuel may be discharged. Optional magnet 64 disposed near the upper end of conveyor 42 attracts and removes ferrous material from the refuse fuel before discharge thereof through chute 62.

Figure 7:
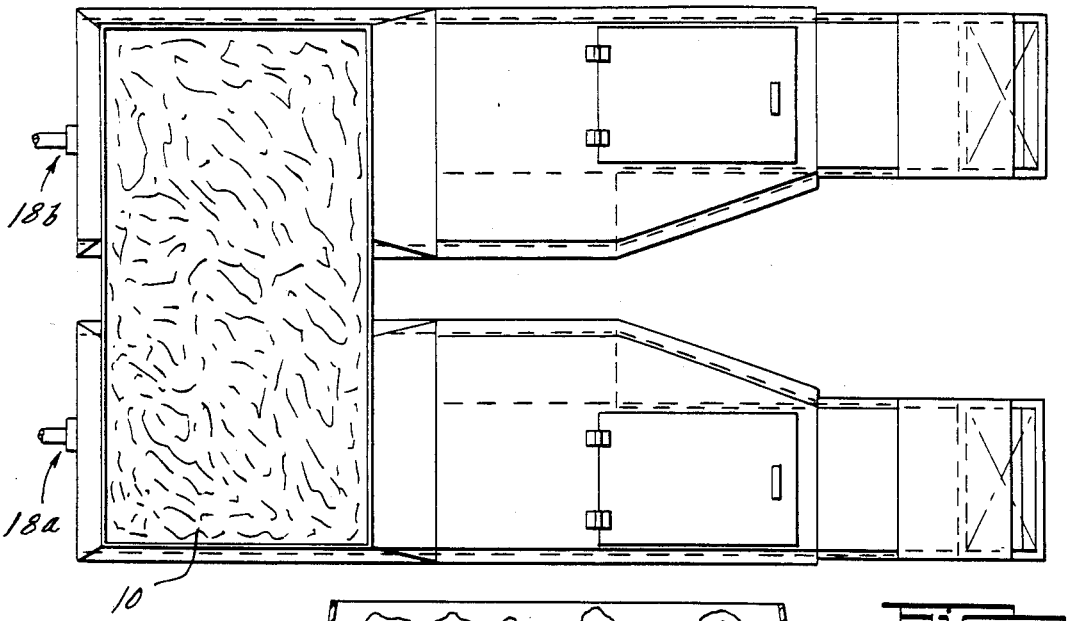
FIG. 7 is a top plan view of a multiple ram embodiment of the present invention.
Figure 9:
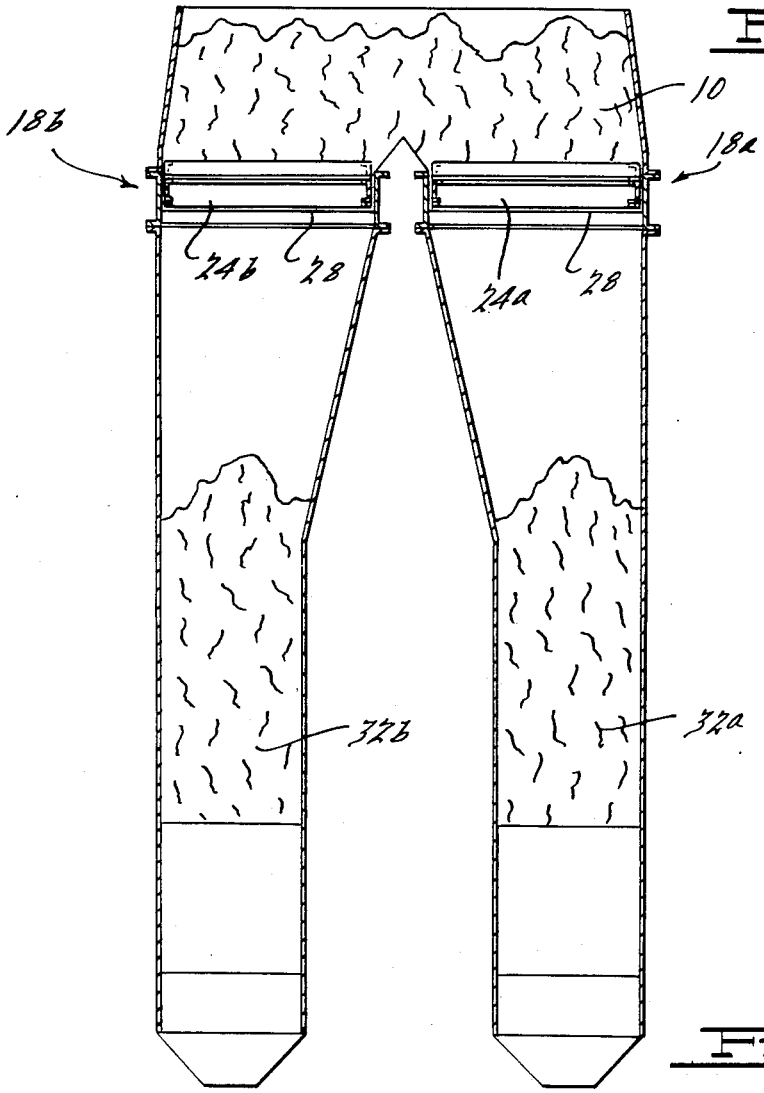
FIG. 9 is a sectional view of the multiple ram embodiment taken along the line 9—9 of FIG. 8.
Figure 8:
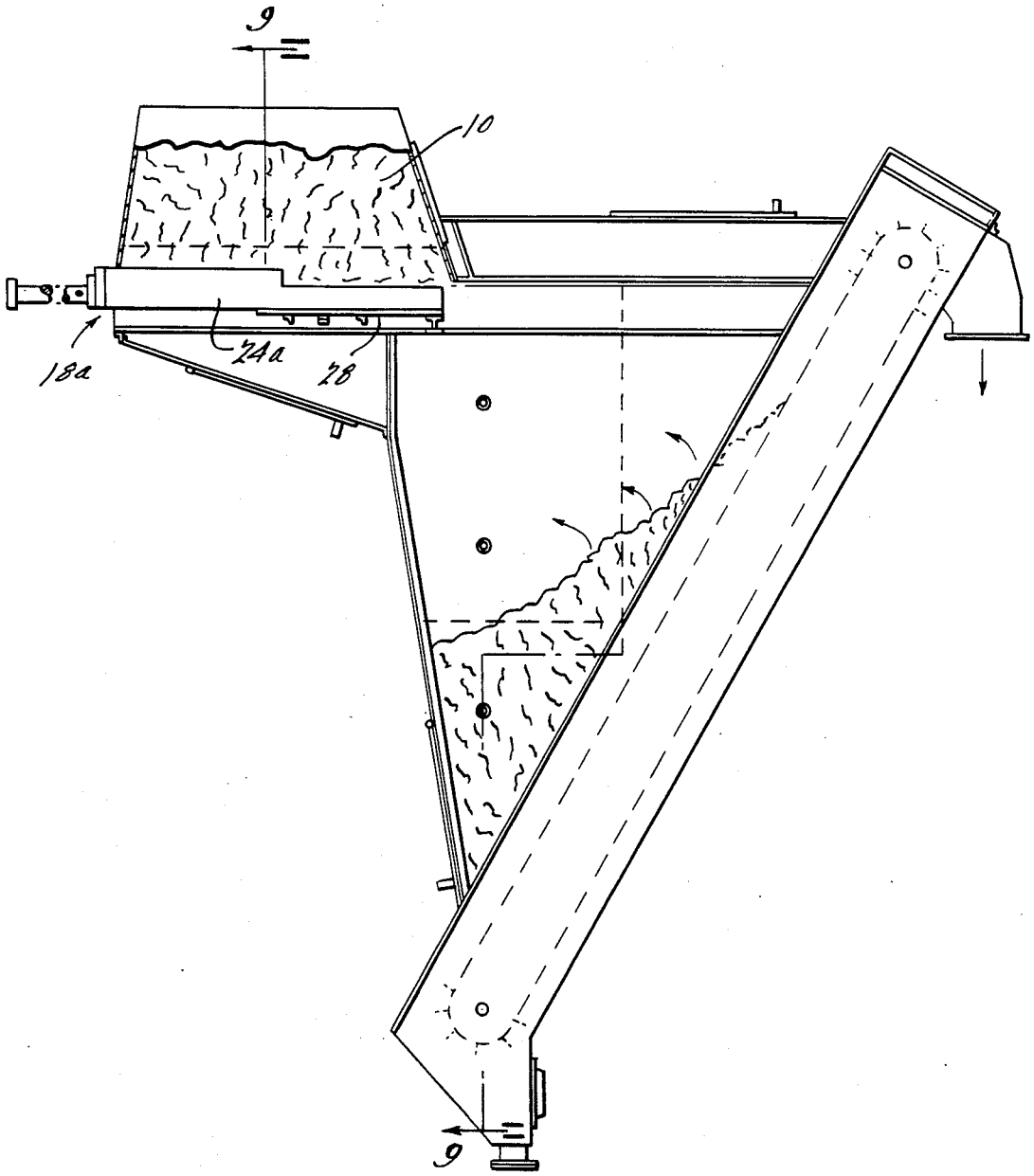
FIG. 8 is a schematic side view of the multiple ram embodiment of FIG. 7.

In another preferred embodiment, shown in FIGS. 7, 8 and 9, a plurality of ram feeders **18*a* and 18*b* are disposed, side by side, along bottom plates 28. Respective rams 24***a* and 24*b* thereof communicate with the interior of hopper 10. Each ram feeder, when actuated, discharges fuel into associated, individual receiving hoppers 32*a* and 32*b* respectively, which include respective inclined conveyors 42*a* and 42*b*. Although two ram feeders/receiving hoppers are illustrated in FIGS. 8 and 9, in general this multiple ram embodiment may entail a greater number without departing from the scope of the invention. Each ram delivers material to an inclined conveyor feeder and each ram receives its control signal from the sensors within its receiving hopper, so that the receiving hopper material level can be individually maintained, if desired. Each individual conveyor, in turn, delivers an independently controllable rate of material through its outlet chute.

Figure 11:
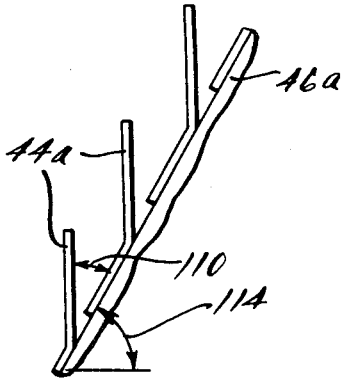
FIG. 11 is a detailed view of the inclined cleats of FIG. 10.

In yet another preferred embodiment, shown in FIGS. 10 and 11, conveyor 42 has a plurality of spaced cleats 44*a*, preferably equally spaced, which are inclined to define an acute angle 110 with respect to the length of belt or chain drive coupling loop 46*a*. The drive coupling loop 46*a* defines a closed course about which cleats 44*a* travel. A portion of conveyor 42*a*, designated generally by reference numeral 112, is disposed to contact the fuel within receiving hopper 32. This portion 112 defines an angle of incline with respect to the horizontal as indicated by reference numeral 114. Cleats disposed along portion 112, such as cleats 116, define an acute angle 110 (with respect to portion 112 of drive coupling loop 46*a*). In the illustrated embodiment, acute angle 110 is generally the complement of the angle of incline 114. In general, however, cleats 44*a* may be disposed with respect to drive coupling loop 46*a* at other angles, as well. It will be seen that the angular relationship provides cleats which are generally vertically arranged along portion 116 to allow for complete filling of the cleats with fuel. As the cleats travel the closed course defined by drive coupling loop 46*a*, they eventually become downwardly directed as at 120 for full and complete discharge through outlet chute 62. It will be understood that the generally vertical orientation of cleats 44*a*, as described above, is intented to cover a range of orientations about the vertical for achieving the described results.

In operation, refuse fuel is placed in hopper 10 through infeed spouts 12. It will be understood that the refuse in hopper 10 is naturally or becomes relatively compacted and intertangled because hopper 10 is normally kept full. In this compacted state the bulk density of the refuse fuel may be on the order of 40 pounds per cubic foot. By activating ram feeder 18 a preselected volume of refuse fuel is forced out, segregated, displaced or otherwise discharged from hopper 10 through discharge opening 26 as illustrated in FIG. 4. Stepped ram 24 feeds material from different portions or strata within hopper 10 which minimizes compacting and clogging tendencies by promoting a rolling action. By feeding material from different portions of the hopper the ejected material is subjected to lower compression forces than with non-stepped rams. This also minimizes compacting tendencies and clogging. It will be understood that the volume of fuel discharged is dependent upon the size of opening 26 and on the displacement or stroke of ram 24, either of these factors being controllable to control the volume of fuel discharged. Once ejected from hopper 10, the refuse fuel drops into hopper 32 which serves to break up or decompact the intertangled refuse. It will be understood that the drop distance D, the distance between discharge opening 26 and the top of the pile of refuse fuel in hopper 32, may be controlled by controlling the level of refuse fuel in hopper 32. Automatic level sensors such as sensors 36 are well suited to provide this control function. A precise level in hopper 32 is also maintained to result in an even and full distribution of material on inclined conveyor 42, so that a controlled and consistent amount is discharged at the upper end of the conveyor.

The decompacted refuse fuel in hopper 32 is removed at a controlled rate by conveyor 42. The rate at which conveyor 42 operates may be controlled by a remote sensor or by the combustion control system of a boiler, air heater, kiln, or the like in order to maintain the boiler steam pressure at a predetermined level or to control on demand the energy output of the boiler, air heater, kiln, or the like. While the invention finds utility as a feeder for combustion devices, in general it may be used to provide a controlled discharge of materials for a wide variety of processes or to a mechanical handling device.

In addition to removing refuse fuel from hopper 32, inclined conveyor 42 also serves to further decompact the refuse fuel in hopper 32 through underraking action and tumbling, whereby refuse fuel is carried up from the bottom of hopper 32 on flights 44 en route to the upper regions of the conveyor. Due to the angle of incline some of the refuse falls or rolls back onto the pile leaving conveyor 42 loaded with a substantially uniform thickness of material. This tumbling or rolling action generally conributes to the decompacting of the refuse fuel in hopper 32. The load of refuse fuel on flights 44 which does not fall back onto the pile is eventually dumped through chute 62 for use in the combustion chamber, air heater, kiln or boiler (not shown). If utilized, optional magnet 64 attracts and holds ferrous particles, which may then be periodically removed through hinged door 34.

It will be understood that the refuse fuel discharged through chute 62 is eventually burned, thereby releasing energy. The energy released may be measured using well known temperature or pressure sensors, such as sensor 61, providing signals to the combustion control system 60. Combustion control system 60 in turn controls motor 59 which can be speeded up or slowed down to control the rate at which fuel is delivered for combustions. Motor 59 may be disposed at any convenient location for imparting rotary motion to the conveyor. In FIG. 1, motor 59 is shown at the bottom of conveyor 42, while in FIG. 5, motor 59 is shown at the top of conveyor 42. The bulk density of the fuel delivered for combustion after decompacting within hopper 32, has been found to be on the order of 5 pounds per cubic foot. In this comparatively loose, low density state, the refuse fuel burns evenly, giving off a relatively uniform amount of energy per unit volume. As the energy demand changes, combustion control system 60 responds by altering the rate at which fuel is removed from hopper 32. Level sensors 36, sensing the quantity of refuse fuel in hopper 32, in turn adjust the rate or volume of refuse fuel discharged from hopper 10 to maintain the desired fuel level in hopper 32.

The refuse feeder thus described may be used along or a number of such refuse feeders acting in concert may be used to feed a single furnace, boiler or other device. The invention permits each feeder to receive a signal from the combustion control system, thus making it possible to bias the feed rate of one feeder with respect to the feed rate of the others in order to optimize the combustion process and to conserve energy. Such an arrangement would also permit shutting down one of the feeders to remove tramp and undesirable material while leaving the others in service. The remaining feeders would automatically step up the feed rate thus the boiler, heater, kiln, etc. can remain on line at full power.

While a presently preferred embodiment of this invention has been illustrated and described in detail, it will be understood that modifications as to details of construction and design are possible without departing from the spirit of the invention or the scope of the following claims.

What is claimed is:

1. An apparatus for delivering fuel for combustion, comprising:

a first hopper for containing a quantity of said fuel;

a second hopper disposed below said first hopper;

displacing means for causing a predetermined volume of fuel to drop from said first hopper into said second hopper; and upwardly extending slat-type conveyor means at least partially disposed within said second hopper for removing fuel from said second hopper for combustion and having an upper portion;

said conveyor means having a closed course of cleats, a portion of said closed course facing interiorly into said second hopper for contacting the fuel therein, said second hopper and said upper portion of said conveyor defining a substantial unrestricted space extending substantially the entire length of said upper portion;

said conveyor means being sufficiently inclined and operable at a speed to promote back tumbling of said fuel from said cleats into said unrestricted space, thereby serving to decompact said fuel before it is delivered for combustion.

2. The apparatus of claim 1 wherein said first hopper has a top portion and a bottom which is wider than said top portion.

3. The apparatus of claim 1 wherein said first hopper has a bottom plate of a first longitudinal dimension and has a fuel discharge opening adjacent said bottom plate; and wherein said displacing means comprises ram pusher reciprocable along said first longitudinal dimension, said ram pusher having vertically arranged first and second pushing surfaces spaced apart a distance less than said first longitudinal dimension, said first pushing surface being disposed below said second pushing surface and nearer to said fuel discharge opening than said second pushing surface.

4. The apparatus of claim 1 wherein said conveyor means defines an angle of incline with the horizontal of approximately greater than twenty degrees.

5. The apparatus of claim 1 wherein said conveyor means defines an angle of incline with the horizontal of approximately between thirty-five and seventy-five degrees.

6. The apparatus of claim 1 wherein said second hopper has a generally inwardly sloping side wall.

7. The apparatus of claim 6 wherein said side wall defines an angle of incline with the horizontal of approximately sixty to ninety degrees.

8. An apparatus for delivering fuel for combustion, comprising:

a first hopper for containing a quantity of said fuel and having a fuel discharge opening in a side of said hopper adjacent the bottom thereof;

an adjustable plate movable along said side for varying the size of said fuel discharge opening;

a second hopper disposed below said first hopper;

ram pusher means for causing a predetermined volume of fuel to drop from said fuel discharge opening and into said second hopper; and upwardly extending conveyor means being sufficiently inclined and operable at a speed to promote back tumbling of said fuel and being at least partially disposed within said second hopper, thereby serving to decompact said fuel before it is delivered for combustion, and for removing fuel from said second hopper for combustion.

9. The apparatus of claim 8 wherein said first hopper has a top portion and a bottom which is wider than said top portion.

10. The apparatus of claim 8 wherein said second hopper has a generally inwardly sloping side wall.

11. The apparatus of claim 10 wherein said side wall defines an angle of incline with the horizontal of approximately sixty to ninety degrees.

12. The apparatus of claim 8 wherein said first hopper has a bottom plate of a first longitudinal dimension and has a fuel discharge opening adjacent said bottom plate; and wherein said ram pusher means has a vertically arranged first and second pushing surfaces spaced apart a distance less than said first longitudinal dimension, said first pushing surface being disposed below said second pushing surface and nearer to said fuel discharge opening than said second pushing surface.

13. An apparatus for delivering fuel for combustion, comprising:

a first hopper for containing a quantity of said fuel and having a fuel discharge opening adjacent the bottom thereof;

an adjustable plate for varying the size of said fuel discharge opening;

a second hopper disposed below said first hopper;

displacing means for causing a predetermined volume of fuel to drop from said fuel discharge opening and into said second hopper; and upwardly extending slat-type conveyor means at least partially disposed within said second hopper for removing fuel from said second hopper for combustion and having an upper portion;

said conveyor means having a closed course of cleats a portion of said closed course facing interiorly into said second hopper for contacting the fuel therein, said second hopper and upper portion defining a substantial unrestricted space extending substantially the entire length of said upper portion;

said conveyor means being inclined approximately between thirty-five and seventy-five degrees relative to the horizontal and being operable at a speed to promote substantial back tumbling of said fuel from said cleats into said unrestricted space, thereby serving to decompact said fuel before it is delivered for combustion.

14. The apparatus of claim 13 wherein said first hopper has a bottom plate of a first longitudinal dimension and has a fuel discharge opening adjacent said bottom plate; and wherein said displacing means comprises ram pusher reciprocable along said first longitudinal dimension, said ram pusher having verticallly arranged first and second pushing surfaces spaced apart a distance less than said first longitudinal dimension, said first pushing surface being disposed below said second pushing surface and nearer to said fuel discharge opening than said second pushing surface.

* * * * *

UNITED STATES PATENT AND TRADEMARK OFFICE

CERTIFICATE OF CORRECTION

PATENT NO. : 4,616,573

DATED : October 14, 1986

INVENTOR(S) : Thomas A. Giaier, et al

It is certified that error appears in the above-identified patent and that said Letters Patent is hereby corrected as shown below:

Column 2, line 45, "stake" should be -- stroke --.

Column 3, line 11, "leve" should be -- level --.

Column 3, line 39, "untanlge" should be -- untangle --.

Column 3, line 40, "dentoed" should be -- denoted --.

Column 3, line 49, "of" (second occurrence) should be -- or --.

Column 4, line 60, "on" should be -- of --.

Column 5, line 47, after "refuse" insert -- fuel --.

Column 6, line 62, "along" should be -- alone --.

Column 8, line 23, Claim 12, after "has" delete -- a --.

Column 8, line 62, Claim 14, "verticallly" should be --vertically--.

Signed and Sealed this

Fifth Day of April, 1988

*Attest:*

DONALD J. QUIGG

*Attesting Officer*

*Commissioner of Patents and Trademarks*